US005409244A

United States Patent [19]

Young

[11] Patent Number: 5,409,244

[45] Date of Patent: Apr. 25, 1995

[54] PLATELESS SNOWBOARD BINDING DEVICE

[76] Inventor: Jeffrey A. Young, P.O. Box 370, W. Aberdeen, Id. 83210

[21] Appl. No.: 90,600

[22] Filed: Jul. 12, 1993

[51] Int. Cl.[6] ..... A63C 5/03; A63C 9/12

[52] U.S. Cl. ..... 280/14.2; 280/611

[58] Field of Search ..... 280/14.2, 611, 617, 280/619, 623, 624, 11.36; 441/70, 74

[56] References Cited

U.S. PATENT DOCUMENTS

| | | | |
|---|---|---|---|
| 2,445,610 | 7/1948 | Drake | 280/611 X |
| 3,143,750 | 8/1964 | Kluge | 441/70 |
| 4,969,655 | 11/1990 | Katz | 280/14.2 |
| 5,147,234 | 9/1992 | Brug | 280/14.2 X |
| 5,261,689 | 11/1993 | Carpenter et al. | 280/14.2 X |

FOREIGN PATENT DOCUMENTS

| | | | |
|---|---|---|---|
| 28409 | 11/1917 | Norway | 280/611 |
| 77881 | 1/1951 | Norway | 280/611 |

*Primary Examiner*—Brian L. Johnson

*Attorney, Agent, or Firm*—Robert C. Curfiss; Butler & Binion

[57] ABSTRACT

A plateless snowboard binding device is designed to eliminate use of base plates in connection with snowboard bindings and allows the snowboarder to exercise maximum control over the speed and direction of the board. The plateless binding device is lightweight and does not promote snow and ice buildup around the boot area. The device includes a flexible strap designed to stay upright for ready fastening and a hinged high-back support for easy transporting and stowing of the board.

23 Claims, 1 Drawing Sheet

PLATELESS SNOWBOARD BINDING DEVICE

BACKGROUND OF THE INVENTION

1. Field of the Invention

The subject invention is generally related to snowboards and is specifically directed to a plateless binding device for use in combination with a snowboard.

2. Description of Prior Art

Snowboarding is the fastest growing winter sport in the world. In this sport, a snowboarder rides a single board, approximately five feet in length, down snow-covered slopes. Although it is most often associated with skiing, snowboarding is comparable to other boarding activities and many of its followers are skateboarders, surfboarders and sailboarders. All snowboards include devices used to fasten the rider's feet to the snowboard. Generally, there are two types of bindings: (1) high-back or buckle bindings and (2) plate bindings. The high-back or buckle bindings are designed for use with soft boots and are typically constructed of plastic. Conventional high-back bindings include a base plate, a high-back support and various types of straps. The basic design of plate bindings consist of a rigid base plate, or a toe and heel plate, onto which the toe and heel extensions of a hard-shelled boot are clamped.

While there are numerous different types of bindings, all prior art snowboard bindings have a base plate which is mounted to the board. A major disadvantage of the prior art snowboard bindings is the reduction of control associated with the mounted base plates. The single most important aspect of snowboarding is mastering control of the speed and direction of the board. The flex of a board refers to the stiffness of the board and is important to the maneuverability and performance of the board. A typical base plate interferes with the flex of a board by creating a "deadspot" on the board where the plate is mounted. Thus, a snowboard equipped with the prior art bindings will have flex from the front of the board to the front binding assembly, then a deadspot, flex between the bindings, then another deadspot and flex from the rear binding assembly to the end of the board. The deadspots created by the base plates affect the maneuverability of the board and result in a reduction of control.

Another disadvantage of the base plates of prior art snowboard bindings is the extra weight they add to the board. An important aspect of snowboarding is the ability of the snowboarder to go airborne. The goal of many freestyle snowboarders is to obtain as much height as possible while performing snowboard tricks. Therefore, a lightweight snowboard is desirable. The weight added to the snowboard by the base plates and mounting screws may prevent a snowboarder from performing certain tricks or obtaining maximum height.

A further disadvantage of the prior art snowboard bindings is that the width of the base plate is permanently set and does not permit adjustment of the bindings. Thus, the width of the bindings cannot be adjusted to create a tight relationship between the boot and the frame of the bindings. Because the bindings are not designed to fit snugly around the base of the boot, the boot may slide back and forth across the base of the bindings and the snowboarder will have less control of the board. In addition, the surface of a snowboard base plate is usually grooved or ribbed. However, a grooved or ribbed surface is not necessary and in fact, collects snow and ice buildup which must later be removed.

While the straps of the bindings meet the functional requirements of snowboard bindings, the prior art straps are not held in an upright position when unfastened and can fall down into the snow. Thus, the snowboarder may have difficulty fastening the straps. Further, high-back snowboard bindings may not include a means for folding the high-back support. If a high-back support is not sufficiently foldable, it may be difficult for the snowboarder to transport and store the board.

Therefore, there is a need for a snowboard binding device which allows for maximum control of the board, is lightweight, does not collect snow and ice buildup and allows for easy transportation and storage of the board.

SUMMARY OF THE INVENTION

The subject invention is directed to a plateless snowboard binding device which allows the snowboarder to exercise maximum control of the speed and direction of the board by eliminating the base plates. The subject invention also includes means for maintaining the straps in an upright position and a hinged high-back support. The plateless binding design eliminates unnecessary weight and minimizes the snow and ice buildup associated with bindings having base plates. It is specifically designed to permit the rider's boots to come in direct contact with the board and to maintain the flex of the board throughout the entire board.

In the preferred embodiment of the invention, the plateless snowboard binding device includes a universal frame for a front boot and a rear boot. Each frame is mounted to the board and is customized to fit snugly on either side of an individual's boot. The binding device includes at least one elongated flexible strap which fits over and secures the boot and a high-back which laterally supports the heel of the boot. The invention may also include an integral hinge located in the lower portion of the high-back support for increasing the convenience of transporting and stowing the snowboard.

The preferred embodiment of the invention also includes a means for retaining the flexible strap in an upright position allowing it to be easily fastened by the snowboarder.

Therefore, it is an object and feature of the subject invention to provide a plateless snowboard binding device which includes a flexible strap and a high-back support, permits the boot to come in direct contact with the board and allows the snowboarder to exercise maximum control of the board.

It is also an object and feature of the subject invention to provide a plateless binding device which does not interfere with the flex of the board.

It is a further object and feature of the subject invention to provide a plateless binding device which can be customized to fit the width of each individual's boot.

It is a further object and feature of the subject invention to provide a plateless binding device which is lightweight permitting the snowboarder to perform certain snowboarding tricks and reach maximum heights.

It is yet another object and feature of the subject invention to provide a plateless binding device which uses the snowboard as the base thereby avoiding snow and ice buildup on the plates.

It is a further object and feature of the subject invention to provide a plateless binding device which includes a hinged high-back support and means for preventing the straps from falling down when they are not fastened.

Other objects and features will be readily apparent from the accompanying drawings and description.

DETAILED DESCRIPTION OF THE PREFERRED EMBODIMENT

Figure 1:
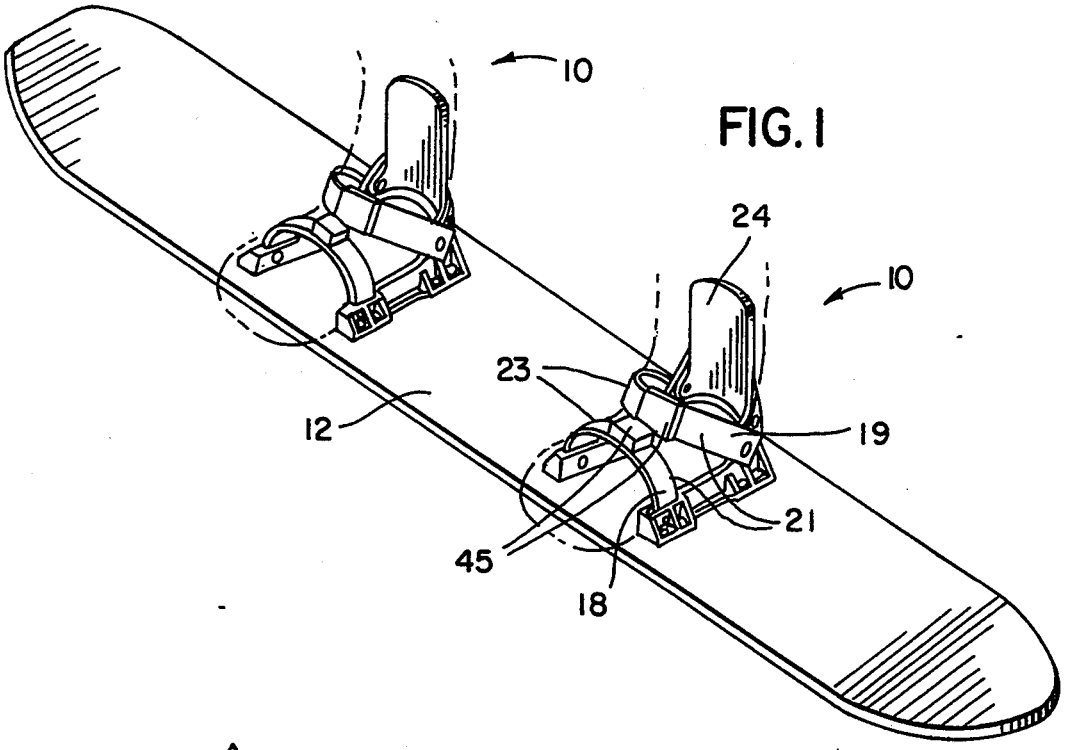
FIG. 1 is a perspective view of the plateless snowboard binding device as mounted to the snowboard.
Figure 2:
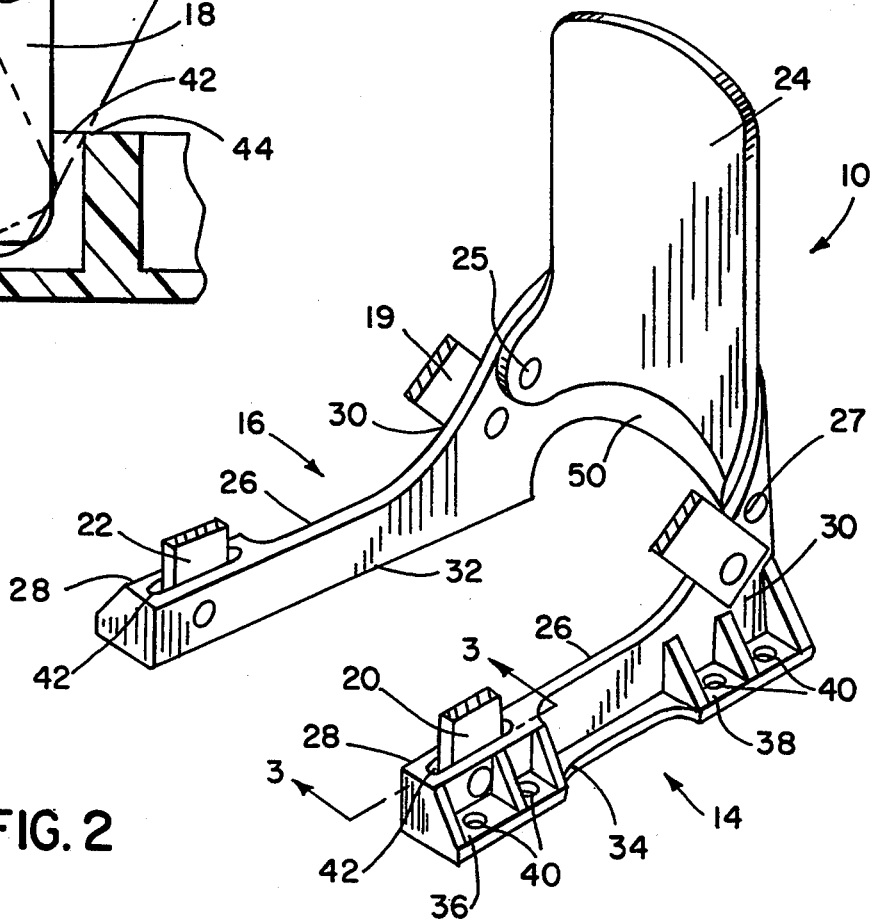
FIG. 2 is a perspective view of the plateless snowboard binding device in accordance with the present invention.

As best shown in FIGS. 1 and 2, the subject invention comprises a plateless binding device 10 for securing a front boot and a rear boot to a snowboard 12. The plateless binding device 10 includes first and second elongated frame members, 14 and 16, a flexible strap 18 having opposite ends 20 and 22, and a high-back support 24. As seen in FIG. 2, the first and second frame members, 14 and 16, comprise a rail 26 having a front end 28, a rear end 30, an inner edge 32 and an outer edge 34. The inner edge 32 is adjacent to the boot when the boot is placed between the first and second frame members, 14 and 16. In the preferred embodiment, the outer edge 34 of each frame member includes a first tab 36 extending laterally outward from the front end 28 and a second tab 38 extending laterally outward from the rear end 30 of the frame member. Each tab 36 and 38 includes two through holes 40 for inserting a screw or other device suitable for mounting the frame members 14 and 16 to the board 12.

In the preferred embodiment, the first frame member 14 is mounted to the board 12 approximately perpendicular to the axis of the board and the second frame member 16 is mounted in a spaced apart position which is substantially parallel to the first frame member 14. The frame members 14 and 16 are specifically positioned so that the inner edge 32 fits snugly on either side of the boot. Because the tight relationship between the boot and the frame of the subject binding device does not permit the boot to slide back and forth, the snowboarder has greater control of the board.

Figure 3:
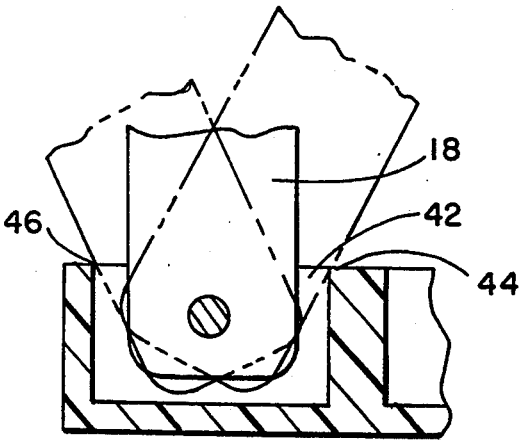
FIG. 3 is an enlarged cross-sectional view taken along line 3—3 of FIG. 2 and showing the slot in the frame member and the limited movement of the strap inserted into the slot.

In the preferred embodiment, the plateless binding device 10 includes a flexible strap 18 pivotally secured to the front end 28 of the frame members, 14 and 16, and a second flexible strap 19 pivotally secured to the rear end 30 of the frame members, 14 and 16. As shown in FIG. 2, the front end 28 of the rail 26 for each frame member includes a slot 42 adapted for receiving the ends 20 and 22 of the flexible strap 18. The pivotal movement of the flexible strap 18 is limited by the abutments as defined by end walls 44 and 46 of the slot 42, as more clearly shown in FIG. 3. The flexible strap 18 and the second flexible strap 19 are each comprised of a first section 21 and a second section 23. The first section 21 is pivotally secured to the first frame member 14 and the second section 23 is pivotally secured to the second frame member 16. In order to secure the boot to the board 12, the flexible strap 18 is fastened by securing the first section 21 to the second section 23 with typical fastener 45, such as a buckle or VELCRO fastener, or the like.

The preferred embodiment of the invention also includes a high-back support 24. The high-back support 24 is secured to the rear end 30 of the frame members, 14 and 16, and laterally supports the heel area of the boot. The high-back support 24 is attached to the rear end 30 by hinges 25 and 27 and is adapted to be folded in toward the board 12 for easier transportation and storage. As shown in FIG. 2, the rails 14 and 16 may include a lateral bridge 50 spanning the rails, permitting the frame members to be of unitary construction. The high-back support 24 is positioned between the bridge 50 and the boot.

While certain features and embodiments of the invention have been described in detail herein, it will be readily understood that the invention includes all modifications and enhancements within the scope and spirit of the following claims.

What is claimed is:

1. A plateless snowboard binding device for retaining a boot on a snowboard, the binding device comprising:

a. a first elongated frame member mounted to the board;

b. a second elongated frame member mounted to the board in a position spaced-apart and substantially parallel to the first frame member, whereby the boot is placed between the first and second frame members and is in direct contact with the board;

c. wherein each of the first and second frame members comprise a rail having an inner and outer edge wherein the inner edge is adjacent to the boot and the outer edge includes one tab extending laterally outward from the rail for mounting the frame members to the board;

d. wherein each rail includes a front end and a rear end and a heel area of the boot is adapted to be positioned at the rear end;

e. a flexible strap secured to the frame members and adapted for fitting over the boot for securing the boot to the board; and f. a support spanning the frame members for laterally supporting the heel area of the boot.

2. The binding device of claim 1, the strap having opposite ends, one end being pivotally attached to the first frame member and the opposite end being pivotally attached to the second frame member.

3. The binding device of claim 1, wherein the one tab is located near the front end, the device further including a second tab located near the rear end.

4. The binding device of claim 1, wherein the one tab includes a through hole for accepting a screw for mounting the frame members to the board.

5. The binding device of claim 1, wherein the strap is pivotally secured to the rail.

6. The binding device of claim 5, the rail further including a positive stop adapted for engaging the strap and for limiting the pivotal movement of the strap.

7. The binding device of claim 6, the abutment further comprising a slot adapted for receiving the strap, the slot further including end walls for limiting the pivotal movement of the strap.

8. The binding device of claim 1, wherein the boot, when positioned between the frame members, includes a toe portion adjacent to the front end and an ankle area near the rear end, wherein the flexible strap is adapted to fit over the toe portion of the boot, said device further including a second flexible strap adapted to fit over the ankle area of the boot.

9. The binding device of claim 1, the flexible strap further having a first and second section, the first section being. attached to the first frame member and the second section being attached to the second frame member, said strap further including a fastener for attaching the first section and the second section for securing the strap over the boot.

10. The binding device of claim 1, the support comprising a high-back component mounted on the binding device at the heel area of the boot.

11. The binding device of claim 10, wherein the high-back component is secured to the rear end of the frame members and defines a bridge between the first and second frame member.

12. The binding device of claim 11, wherein the high-back component is secured to the frame members by a hinge whereby the high-back component may be folded in toward the board.

13. A plateless snowboard binding system including a binding device for retaining a boot on a snowboard, the binding device comprising:

a. a first elongated frame member mounted to the board;

b. a second elongated frame member mounted to the board in a position spaced-apart and parallel to the first frame member, whereby the boot is placed between the first and second frame members and is in direct contact with the board;

c. wherein each of the first and second frame members comprise a rail having an inner and outer edge wherein the inner edge is adjacent to the boot and the outer edge includes one tab extending laterally outward from the rail for mounting the frame members to the board;

d. wherein the first and second frame members include a front end and a rear end and a heel area of the boot is located at the rear end;

e. a flexible strap pivotally connected to the frame members and adapted for fitting over the boot for securing the boot to the board;

f. a positive stop adapted for engaging the strap and for limiting the pivotal movement of the flexible strap; and g. a hinged support located at the rear end of the frame members for laterally supporting the heel area of the boot.

14. The binding device of claim 13, the strap having opposite ends, one end being pivotally attached to the first frame member and the opposite end being pivotally attached to the second frame member.

15. The binding device of claim 13, wherein the one tab is located near the front end, the device further including a second tab located near the rear end.

16. The binding device of claim 13, wherein the one tab includes a through hole for accepting a screw for mounting the frame members to the board.

17. The binding device of claim 13, wherein the strap is pivotally secured to the rail.

18. The binding device of claim 17, the rail further including the positive stop for limiting the pivotal movement of the strap.

19. The binding device of claim 18, the abutment further comprising a slot adapted for receiving the strap, the slot further including end walls for limiting the movement of the strap.

20. The binding device of claim 13, wherein the boot, when positioned between the frame members, includes a toe portion adjacent to the front end and an ankle area near the rear end, wherein the flexible strap is adapted to fit over the toe portion of the boot, said device further including a second flexible strap adapted to fit over the ankle area of the boot.

21. The binding device of claim 13, the flexible strap further having a first and second section, the first section being attached to the first frame member and the second section being attached to the second frame member, said strap further including a fastener attaching the first section and the second section for securing the strap over the boot.

22. The binding device of claim 13, the.support comprising a high-back component mounted on the binding device at the heel area of the boot.

23. The binding device of claim 22, wherein the high-back component is secured to the rear end of the frame members by a hinge whereby the high-back component may be folded in toward the board, the high-back component further defining a bridge between the first and second frame member.

* * * * *